US012188337B2

(12) United States Patent
Frost

(10) Patent No.: US 12,188,337 B2
(45) Date of Patent: Jan. 7, 2025

(54) GAS DISPERSAL TOOL AND ASSOCIATED METHODS AND SYSTEMS

(71) Applicant: ODESSA SEPARATOR, INC., Odessa, TX (US)

(72) Inventor: Cavin Bert Frost, Odessa, TX (US)

(73) Assignee: ODESSA SEPARATOR, INC., Odessa, TX (US)

( * ) Notice: Subject to any disclaimer, the term of this patent is extended or adjusted under 35 U.S.C. 154(b) by 46 days.

(21) Appl. No.: 18/059,114

(22) Filed: Nov. 28, 2022

(65) Prior Publication Data

US 2023/0167724 A1 Jun. 1, 2023

Related U.S. Application Data

(60) Provisional application No. 63/284,850, filed on Dec. 1, 2021.

(51) Int. Cl.
*E21B 43/16* (2006.01)
*E21B 21/08* (2006.01)

(52) U.S. Cl.
CPC ..... *E21B 43/168* (2013.01); *E21B 21/08* (2013.01)

(58) Field of Classification Search
CPC ..... E21B 43/122; E21B 43/168; E21B 21/08; E21B 43/123; E21B 43/166
See application file for complete search history.

(56) References Cited

U.S. PATENT DOCUMENTS 1,837,669 A * 12/1931 Pendleton ..... E21B 43/122 417/118
3,407,830 A * 10/1968 Reagan ..... E21B 43/123 137/155
3,633,674 A * 1/1972 Brieger ..... E21B 43/10 166/381
4,083,660 A * 4/1978 Newbrough ..... E21B 43/124 417/172
4,430,858 A * 2/1984 Shaw ..... F03B 17/02 417/159
8,336,623 B2 12/2012 Langdon et al.
2005/0199391 A1 9/2005 Cudmore et al.
2020/0217179 A1* 7/2020 Reeves ..... E21B 43/122

* cited by examiner

*Primary Examiner* — David Carroll
(74) *Attorney, Agent, or Firm* — Smith IP Services, P.C.

(57) ABSTRACT

A can include a gas injection mandrel configured to inject a gas into fluids produced into a flow passage of a production string, and a gas dispersal tool including at least one turbulence-inducing structure configured to disperse the gas in the fluids. A method can include connecting a gas dispersal tool in a production string, producing fluids into a flow passage extending longitudinally through the production string, and injecting a gas into the flow passage, thereby causing the gas and the fluids to flow through the gas dispersal tool, and the gas dispersal tool dispersing the gas in the fluids. A gas dispersal tool can include a generally tubular outer housing, a flow passage extending longitudinally through the outer housing, and at least one turbulence-inducing structure in the flow passage, the turbulence-inducing structure being configured to disperse gas in a flow of produced fluid through the flow passage.

19 Claims, 5 Drawing Sheets

GAS DISPERSAL TOOL AND ASSOCIATED METHODS AND SYSTEMS

BACKGROUND

This disclosure relates generally to equipment utilized and operations performed in conjunction with a subterranean well and, in an example described below, more particularly provides for gas dispersal in a producing well.

Gas injection is an artificial lift technique that is used when pressure in a producing earth formation is insufficient to displace produced fluids (oil, water, gas condensates, etc.) to surface. The gas injected into the produced fluids is intended to reduce a density of the produced fluids, thereby enabling the produced fluids to flow to the surface.

It will, therefore, be readily appreciated that improvements are continually needed in the art of gas injection. The present specification provides such improvements, which may be used in a variety of different well configurations and methods.

DETAILED DESCRIPTION

Figure 1:
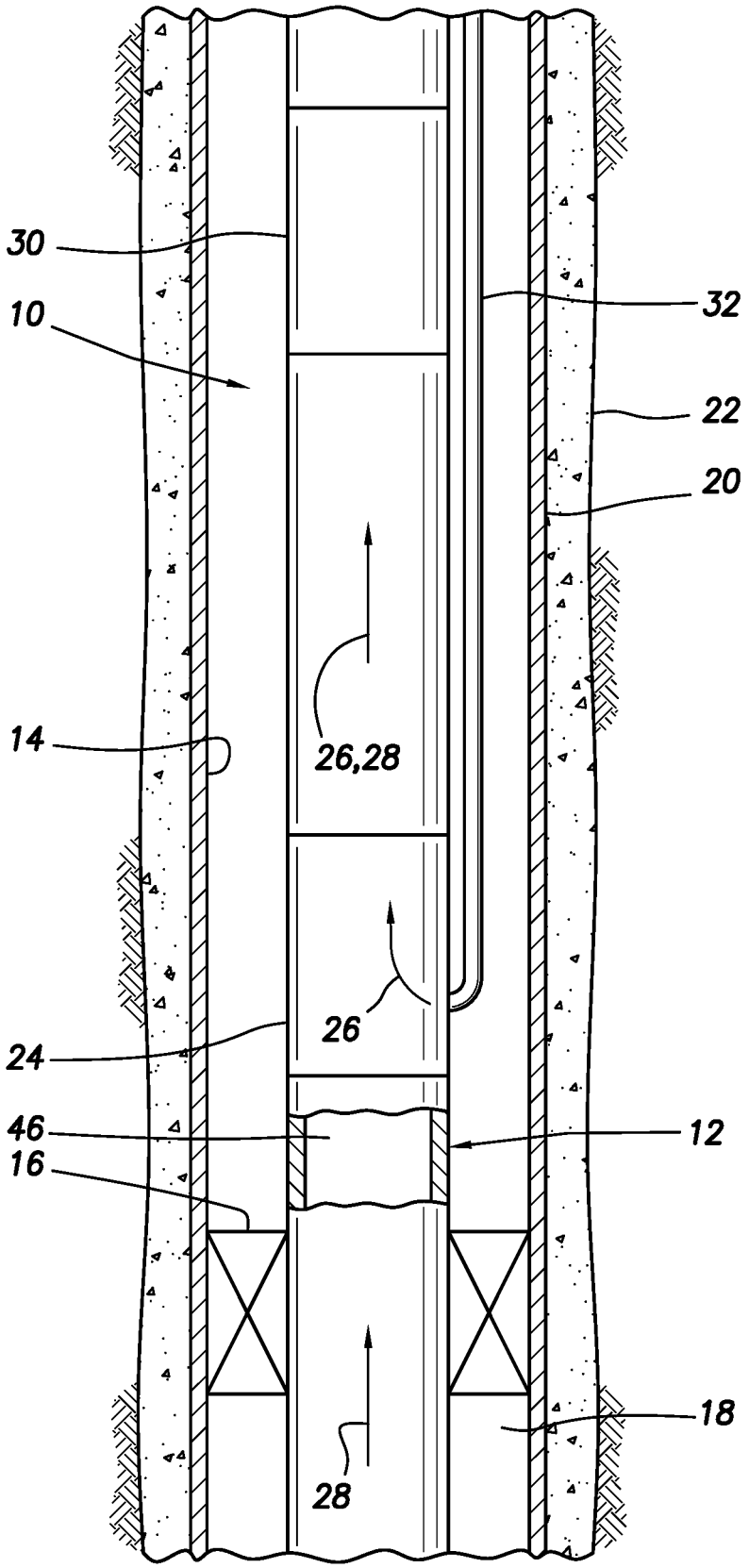
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the system 10 of FIG. 1, a generally tubular production string 12 has been installed in a wellbore 14. A packer 16 seals off an annulus 18 formed radially between the production string 12 and the wellbore 14. The wellbore 14 is generally vertical and lined with casing 20 and cement 22 in this example, but in other examples the wellbore could be inclined from vertical and could be uncased or open hole in a section in which the principles of this disclosure are practiced.

As depicted in FIG. 1, the production string 12 includes a gas injection mandrel 24 connected above the packer 16. The gas injection mandrel 24 is used to inject gas 26 into a flow of fluids 28 produced into a flow passage 46 extending through the production string 12. In this manner, the combined gas 26 and fluids 28 have a reduced density (as compared to the fluids 28 alone), which assists in producing the fluids to surface.

However, the production string 12 may be many thousands of feet in length, and so the gas 26 could separate from the fluids 28 while they flow upward toward the surface. In order to maintain the gas 26 adequately dispersed in the fluids 28, the FIG. 1 production string 12 includes a gas dispersal tool 30 connected above the gas injection mandrel 24. Although the gas dispersal tool 30 is depicted in relatively close proximity to the gas injection mandrel 24 as viewed in FIG. 1, in actual practice the gas dispersal tool may be connected a thousand or more feet above the injection mandrel. More than one gas dispersal tool 30 may be connected in the production string 12.

One of the methods which may be used to produce fluids 28 from wells to the surface is known to those skilled in the art as a gas lift system. This system uses natural gas, typically produced in the well, to provide lift for the column of fluids 28 within the production string 12. The injection of gas 26 effectively reduces the density of the fluids 28, lowering hydrostatic pressure in the production string 12, which causes increased flow from a reservoir into the wellbore 14 and up the production string.

Gas 26 is injected into a line 32 or the annulus 18 between the production string 12 and the casing 20 above the packer 16. A gas lift valve (not shown) in the gas injection mandrel 24 allows the gas 26 to be introduced into the production string 12 as needed to provide sufficient lifting force to produce the fluids 28 to the surface.

Because of the typically thousands of feet of fluid column, the production string 12 becomes, in effect, a gas separator. As the combined fluids 28 and gas 26 rises, the gas has opportunity to break out of liquid phase and rise to the top of the fluid column. In deviated and unconventional wells, gas 26 rises to the high side of the production string 12, further enhancing gas separation.

As gas 26 bubbles rise, they accumulate and increase in size and can eventually out-pace the fluids 28. This can result in a loss of the ability of the gas to provide lifting energy and the heavier fluids 28 may experience "fall-back" (descending in the production string 12). This results in decreased efficiency, lower production, and can potentially kill the well.

Figure 2:
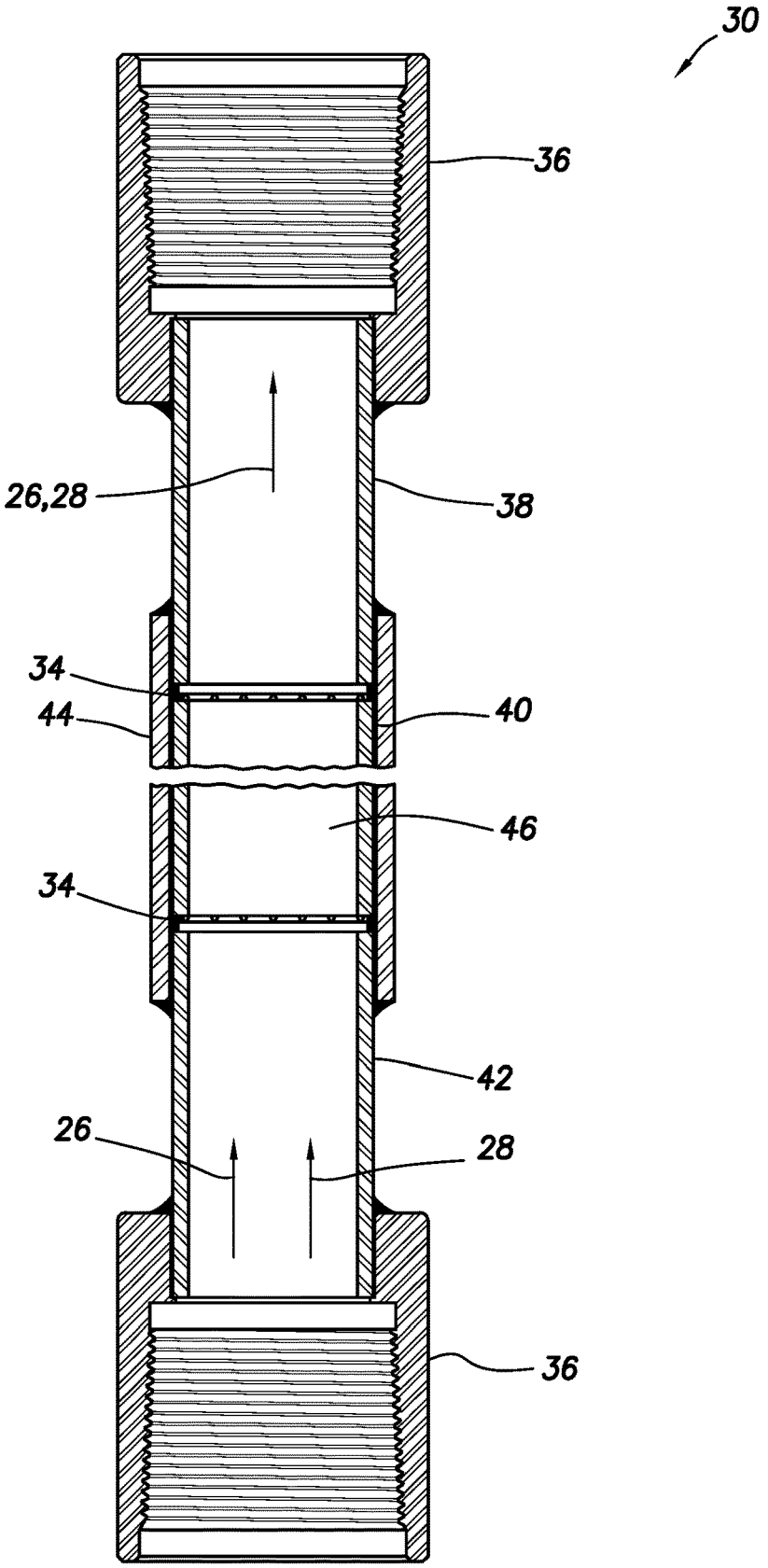
FIG. 2 is a representative cross-sectional view of an example of a gas dispersal tool that may be used with the FIG. 1 system and method.

Referring additionally now to FIG. 2, a cross-sectional view of an example of the gas dispersal tool 30 is representatively illustrated. The FIG. 2 gas dispersal tool 30 may be used in the system 10 and method of FIG. 1, or it may be used in other systems and methods.

The gas dispersal tool 30 works to mechanically reverse the natural separation that occurs within the production string 12 liquid column. The gas dispersal tool 30 introduces turbulence into the flow path, causing decreased velocity which provides a more controlled lift as gas 26 is entrained back into the liquid phase. Gas bubbles are sheared by the agitation introduced by the gas dispersal tool 30, breaking them up into smaller, more controlled bubbles.

The gas dispersal tool 30 may use various means to cause turbulence and gas bubble surface tension break-up. This may be achieved by constriction, physical ridges or nodes, expanded metal, steel wool, screens, circuitous channels and other means. In the FIG. 2 example, multiple screens 34 are positioned across the flow passage 46 extending longitudinally through the gas dispersal tool 30.

In some examples, the physical structures (such as, screens, restrictions, ridges, steel wool, circuitous channels, etc.) within the gas dispersal tool 30 can be displaced (such as, via wireline or coiled tubing) to enable access below the tool. In this manner, work may be performed below the tool 30 without the necessity of pulling the production string 12 (which is time consuming and expensive).

Depending on well depth, bottom hole pressure, production levels, gas/oil ratio, fluid column level and other well conditions, multiple gas dispersal tools 30 may be used at varying levels in the production string 12. This gives the well operator more control of the gas lift system and stabilizes production efficiency, which enhances production.

In the FIG. 2 example, the gas dispersal tool 30 is configured to be installed in line with standard tubing commonly used for production in oil and gas wells. Sizes may include 2⅜", 2⅞", 3½" and other tubular sizes. In one embodiment, each end of the tool 30 consists of a threaded box collar 36 for connection to tubing above and below the tool in the production string 12.

A body of the tool 30 comprises three inner housing sections 38, 40, 42. The center section 40 has circular V-shaped wire screens 34 positioned at each end. In this example, the V wire screen 34 on one end is oriented vertically, and on the other end, the V wire screen is oriented horizontally (e.g., the V wire is oppositely oriented at the respective opposite ends of the inner housing section 40). This causes optimum shearing of gas 26 bubbles and entrainment of the bubbles back into the wellbore fluids 28. This in turn decreases the density of the combined gas 26 and fluids 28, making it flow more readily up the production string 12.

The inner housing sections 38, 40, 42 are connected together with the use of an outer housing 44 which extends over the center inner housing section 40. This outer housing 44 is welded into place over the inner housing sections 38, 40, 42, with the two V wire screens 34 secured between the inner housing sections.

On occasion, operators may need access to the wellbore 14 below the tool 30 to complete work down hole. This can be achieved more cost effectively through the use of wireline or coiled tubing than by pulling the production string 12.

One means of using wireline to remove any obstructions in the tool 30 may include the use of diminishing sized dispersal sections (each of which includes turbulence inducing structures, such as, screens, restrictions, ridges, steel wool, circuitous channels, etc.) in the inner housings. The wireline may be utilized with an overshot tool to connect to and remove dispersal sections, enabling access to the bottom of the well via the flow passage 46.

Figure 3:
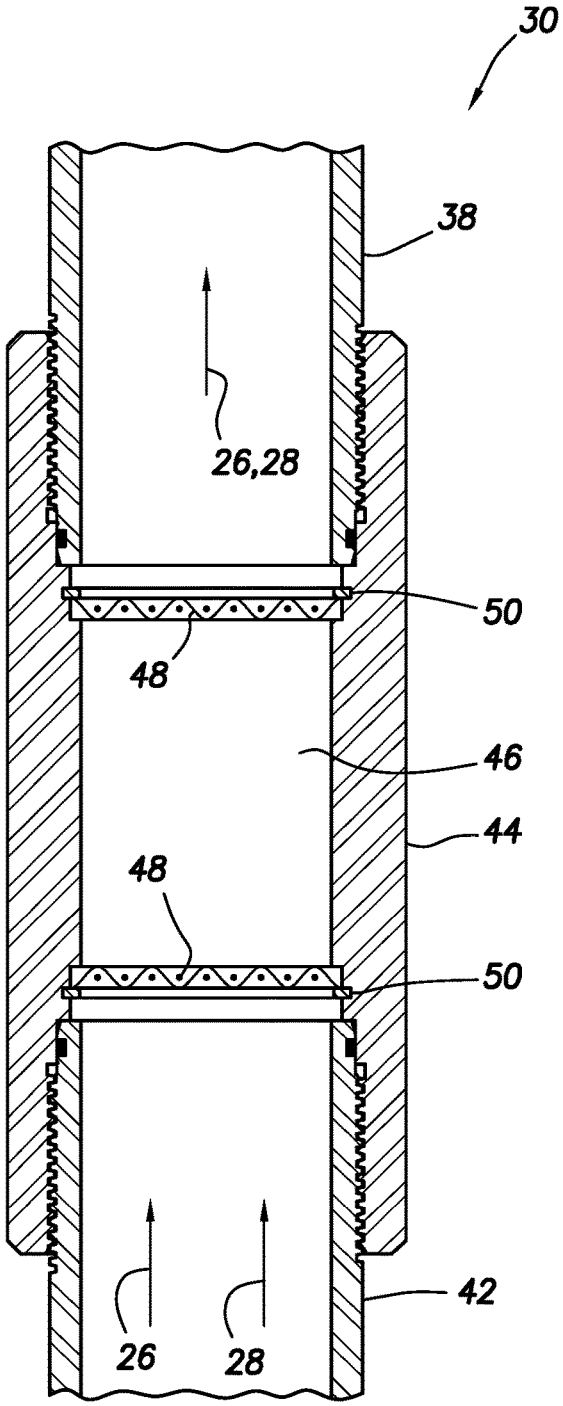
FIG. 3 is a representative cross-sectional view of another example of the gas dispersal tool.

Referring additionally now to FIG. 3, another example of the gas dispersal tool 30 is representatively illustrated. The FIG. 3 dispersal tool 30 differs from the FIG. 2 example at least in that the middle inner housing 40 is not used, the V wire screens 34 are not used, and the upper and lower housings 38, 42 are releasably connected to the outer housing 44 (such as, using thread connections sealed with o-rings).

In the FIG. 3 example, the dispersal sections or screens 48 are in the form of wire mesh screens (such as, woven wire mesh screens). The screens 48 are secured in the outer housing 44 by use of releasable retainers 50 (such as, resilient snap rings or C shaped rings). The screens 48 may be oriented differently (e.g., at 45 degrees relative to each other) in the outer housing 44 to enhance dispersal of the gas 26 in the produced fluids 28 as it flows through the flow passage 46.

Other types of screens may be used instead of, or in addition to, the screens 34, 48 in any of the gas dispersal tool 30 examples described herein. For example, expanded metal having openings (such as, slits, perforations, etc.) therein can be used to induce turbulence in the flow of the gas 26 and produced fluids 28.

Figure 4:
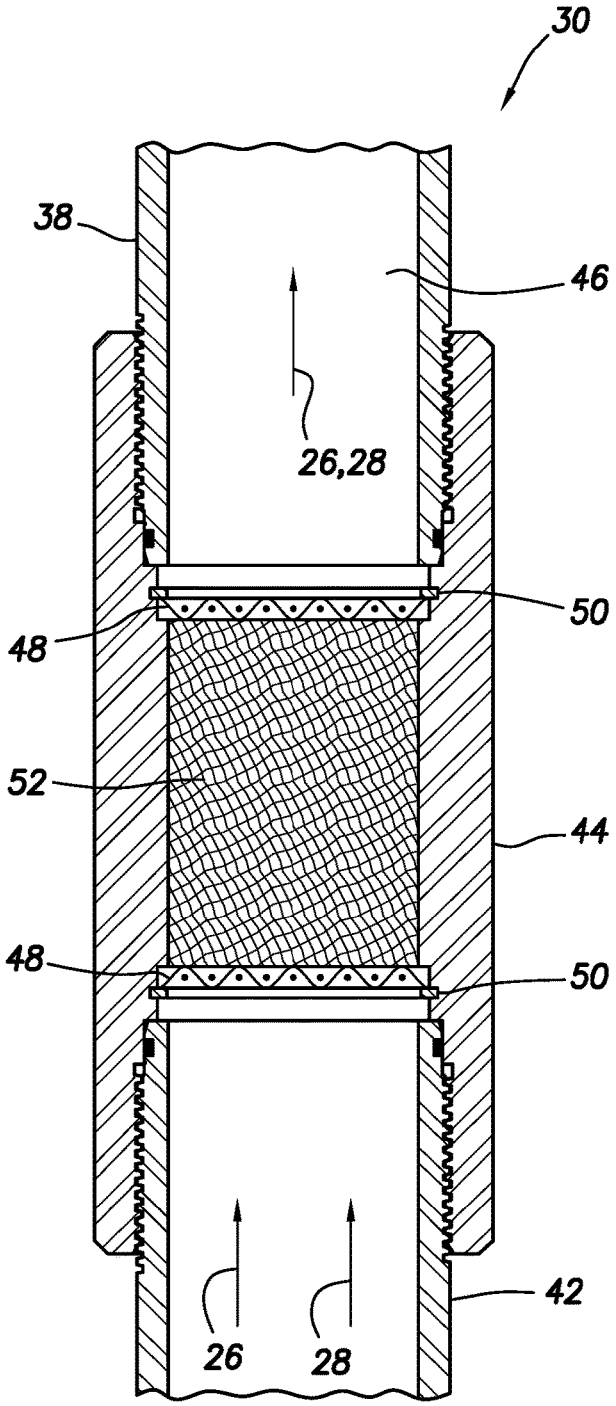
FIG. 4 is a representative cross-sectional view of another example of the gas dispersal tool.

Referring additionally now to FIG. 4, a cross-sectional view of another example of the gas dispersal tool 30 is representatively illustrated. The FIG. 4 gas dispersal tool 30 is similar to the FIG. 3 example, but differs in that the FIG. 4 gas dispersal tool includes a steel wool 52 positioned in the flow passage 46 longitudinally between the screens 48. The steel wool 52 enhances the dispersal of the gas 26 in the produced fluids 28 as they flow through the steel wool.

Figure 5:
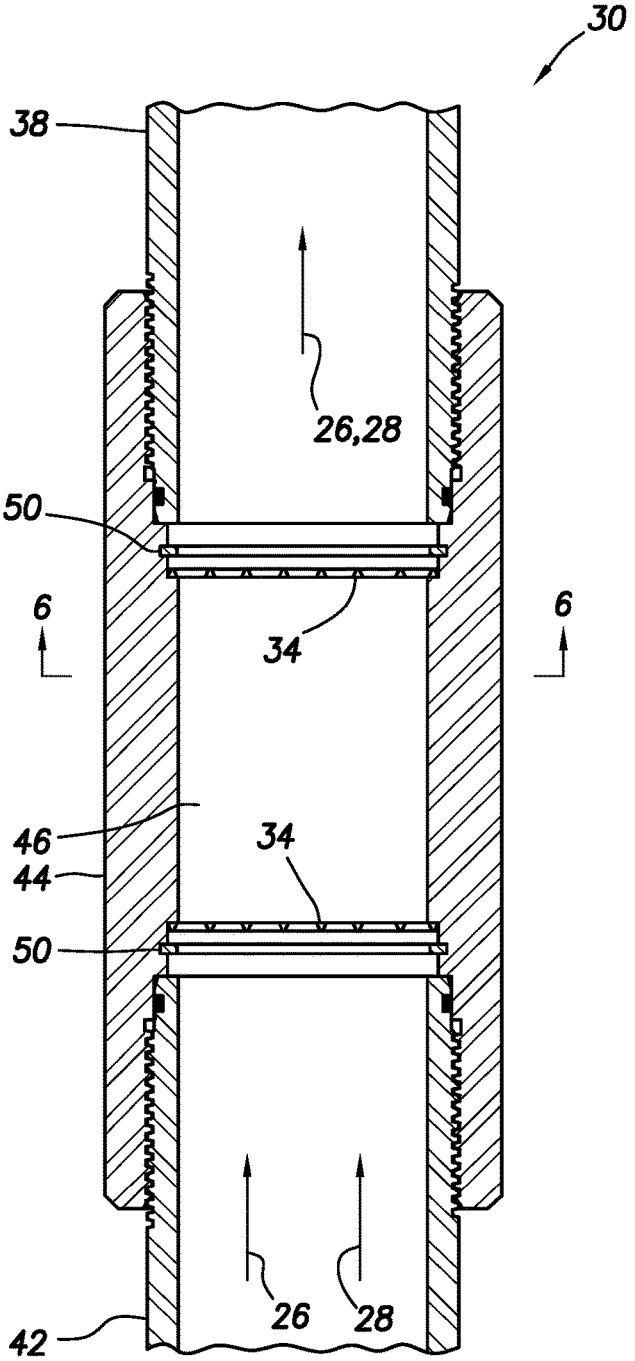
FIG. 5 is a representative cross-sectional view of another example of the gas dispersal tool.
Figure 6:
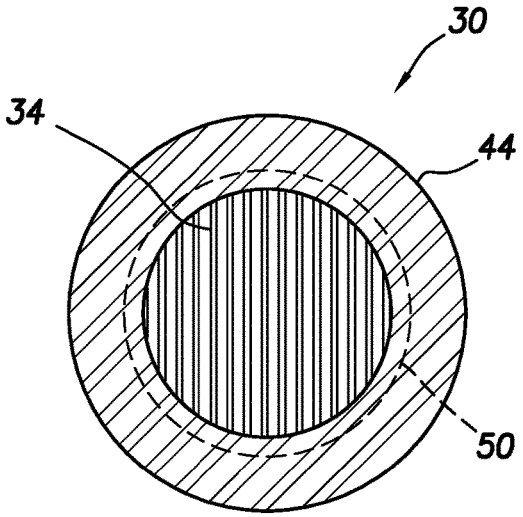
FIG. 6 is a representative cross-sectional view of the FIG. 5 gas dispersal tool, taken along line 6-6 of FIG. 5.

Referring additionally now to FIGS. 5 & 6, cross-sectional views of another example of the gas dispersal tool 30 are representatively illustrated. The FIG. 5 gas dispersal tool 30 is similar to the FIG. 3 example, but differs in that the V wire screens 34 are used instead of the wire mesh screens 48. The steel wool 52 may be used between the V wire screens 34 (as in the FIG. 4 example), if desired.

As depicted in FIG. 6, the V-shaped wire of the upper screen 34 is oriented horizontally. The V-shaped wire of the lower screen 34 may be oriented orthogonal to that of the upper screen, so that the V-shaped wire of the lower screen would be vertical as viewed in a lateral cross-section. Thus, the upper screen 34 is oriented different than the lower screen 34 relative to the flow passage 46.

Figure 7:
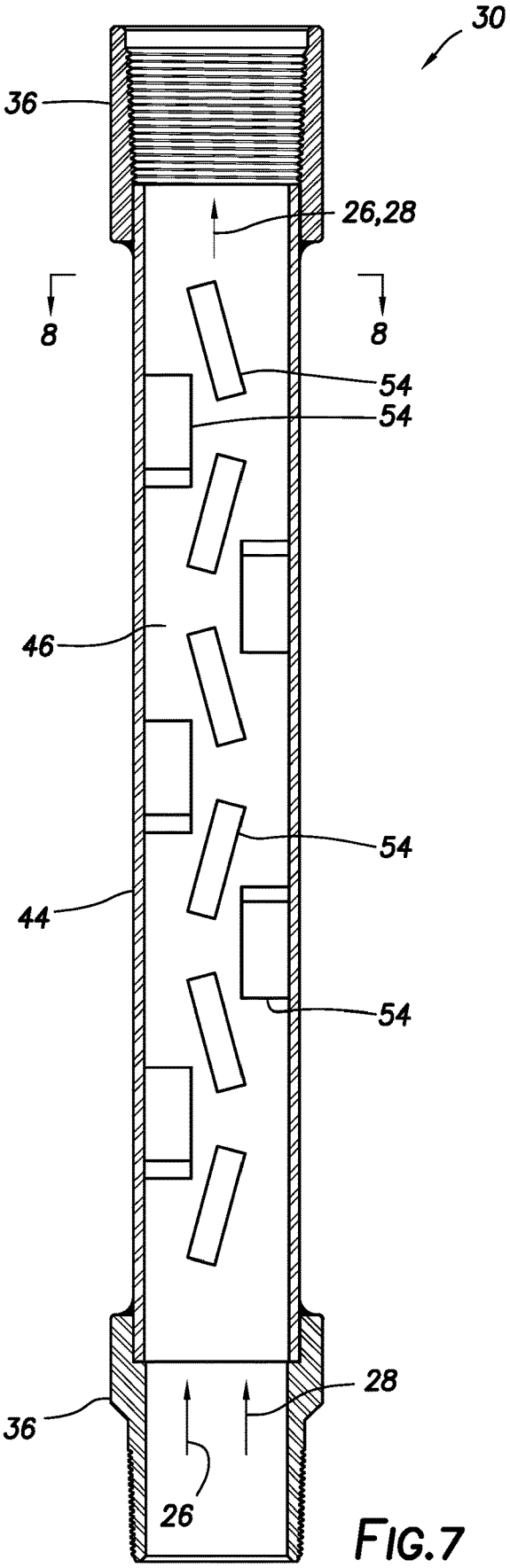
FIG. 7 is a representative cross-sectional view of another example of the gas dispersal tool.
Figure 8:
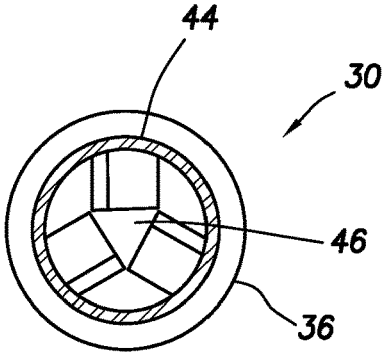
FIG. 8 is a representative cross-sectional view of the FIG. 7 gas dispersal tool, taken along line 8-8 of FIG. 5.

Referring additionally now to FIGS. 7 & 8, cross-sectional views of another example of the gas dispersal tool 30 are representatively illustrated. The FIG. 7 gas dispersal tool 30 differs from the other examples described herein, in that screens or steel wool are not used to disperse the gas 26 flowing through the tool. Instead, the FIG. 7 example includes turbulence-inducing structures 54 in the flow passage 46.

The structures 54 may be any type of structures capable of inducing turbulence in the flow of the gas 26 and fluids 28, or otherwise break up the gas and cause it to disperse more evenly in the produced fluids. For example, the structures 54 can include ridges, nodes and bluff bodies. The structures 54 may form circuitous channels, restrictions to flow or constrictions in the flow passage 46.

In some examples, screens (such as, the screens 34, 48 described above) and/or steel wool 52 may be used with the structures 54 in the FIGS. 7 & 8 example. The structures 54 could be incorporated into any of the other examples of FIGS. 2-6. Thus, the scope of this disclosure is not limited to any particular configuration or combination of features depicted in the drawings or described herein.

It may now be fully appreciated that the above disclosure provides significant advancements to the art of gas injection in producing wells. In a variety of examples described above, the gas dispersal tool 30 can be used to ensure that dispersal of the gas 26 is enhanced in the fluids 28 produced from a well, so that gas separation is mitigated.

The above disclosure provides to the art a gas dispersal tool 30, system 10 and method, in which the tool 30 is connected in a production string 12 above a gas injection mandrel 24 or gas lift valve. The gas dispersal tool 30 may include one or more turbulence inducing structures 34, 48, 54 in an internal flow passage 46 of the tool.

The turbulence inducing structures 34, 48, 54 may include one or more of physical ridges or nodes, expanded metal, steel wool and screens, and the structures may form restrictions, constrictions or circuitous channels in the flow passage 46. The turbulence inducing structures 34, 48, 54 may be moveable to thereby permit access through the flow passage 46. The turbulence inducing structures 34, 48, 54 disperse gas 26 in fluids 28 produced from the well.

The above disclosure provides to the art a gas dispersal tool 30, system 10 and method, in which one or more gas dispersal sections or structures 34, 48, 54 are secured between inner housing sections 38, 40, 42, so that the structures extend across a flow passage 46 extending longitudinally through the inner housing sections. The inner housing sections 38, 40, 42 may be connected via an outer housing 44 welded to two of the inner housing sections 38, 42.

The structures 34, 48, 54 may be moveable to permit access to a production string 12 interior below the tool 30. The gas dispersal tool 30 may be connected above a gas injection mandrel 24 or gas lift valve.

A system 10 for use with a producing subterranean well is described above. In one example, the system 10 can comprise: a gas injection mandrel 24 configured to inject a gas 26 into fluids 28 produced into a flow passage 46 of a tubular production string 12, and a gas dispersal tool 30 including at least one turbulence-inducing structure 34, 48, 54 configured to disperse the gas 26 in the fluids 28. The gas dispersal tool 30 may be connected above the gas injection mandrel 24 in the production string 12.

The turbulence-inducing structure may comprise at least one screen 34, 48 that extends across the flow passage 46. The "at least one screen" may comprise first and second screens 34, 48, and the first screen may be oriented different than the second screen relative to the flow passage 46.

A steel wool 52 may be positioned in the flow passage 46. The screen 34, 48 may comprise at least one of a V wire screen and a wire mesh screen.

The turbulence-inducing structure 54 may form in the flow passage 46 at least one of a circuitous channel, a restriction and a constriction.

A method of producing fluids 28 from a subterranean well is also described above. In one example, the method can comprise: connecting a gas dispersal tool 30 in a tubular production string 12; producing the fluids 28 into a flow passage 46 extending longitudinally through the production string 12; and injecting a gas 26 into the flow passage 46, thereby causing the gas 26 and the fluids 28 to flow through the gas dispersal tool 30, so that the gas dispersal tool 30 disperses the gas 26 in the fluids 28.

The connecting step can comprise connecting the gas dispersal tool 30 above a gas injection mandrel 24. The injecting step can comprise injecting the gas 26 into the flow passage 46 via the gas injection mandrel 24.

The dispersing step can comprise the gas 26 and the fluids 28 flowing through turbulence-inducing structures 34, 48, 54 of the gas dispersal tool 30. The turbulence-inducing structures may comprise at least one screen 34, 48 that extends across the flow passage 46.

The "at least one screen" may comprise first and second screens 34, 48. The method may include orienting the first and second screens 34, 48 differently relative to the flow passage 46. The method may include positioning a steel wool 52 between the first and second screens 34, 48.

Also described above is a gas dispersal tool 30 for use in a subterranean well. In one example, the gas dispersal tool 30 can include a generally tubular outer housing 44, a flow passage 46 extending longitudinally through the outer housing 44, and at least one turbulence-inducing structure 34, 48, 54 in the flow passage 46. The turbulence-inducing structure 34, 48, 54 is configured to disperse gas 26 in a flow of produced fluid 28 through the flow passage 46.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A system for use with a producing subterranean well, the system comprising:

a gas injection mandrel configured to inject a gas into fluids produced into a flow passage of a tubular production string; and a gas dispersal tool including at least one turbulence-inducing structure configured to disperse the gas in the fluids, in which the turbulence-inducing structure comprises first and second screens, and in which the first screen is circumferentially rotated relative to the second screen.

2. The system of claim 1, in which the gas dispersal tool is connected above the gas injection mandrel in the production string.

3. The system of claim 1, in which each of the first and second screens extends across the flow passage.

4. The system of claim 1, in which the turbulence-inducing structure is configured for removal from the well without removing the tubular production string.

5. The system of claim 1, in which a steel wool is positioned in the flow passage.

6. The system of claim 1, in which the first and second screens comprise at least one of the group consisting of a V wire screen and a wire mesh screen.

7. The system of claim 1, in which the turbulence-inducing structure forms in the flow passage at least one of the group consisting of a circuitous channel, a restriction and a constriction.

8. A method of producing fluids from a subterranean well, the method comprising:

connecting a gas dispersal tool in a tubular production string;

producing the fluids into a flow passage extending longitudinally through the production string; and injecting a gas into the flow passage, thereby causing the gas and the fluids to flow through the gas dispersal tool, and the gas dispersal tool dispersing the gas in the fluids, in which the dispersing comprises the gas and the fluids flowing through turbulence-inducing structures of the gas dispersal tool, in which the turbulence-inducing structures comprise first and second screens, and in which the first screen is circumferentially rotated relative to the second screen.

9. The method of claim 8, in which the connecting comprises connecting the gas dispersal tool above a gas injection mandrel.

10. The method of claim 9, in which the injecting comprises injecting the gas into the flow passage via the gas injection mandrel.

11. The method of claim 8, further comprising removing the gas dispersal tool from the well without removing the production string, thereby providing access to a portion of the well below the tool.

12. The method of claim 8, in which each of the first and second screens extends across the flow passage.

13. The method of claim 8, in which the first and second screens comprise at least one of the group consisting of a V wire screen and a wire mesh screen.

14. The method of claim 8, further comprising positioning a steel wool between the first and second screens.

15. A gas dispersal tool for use in a subterranean well, the gas dispersal tool comprising:

a tubular outer housing;

a flow passage extending longitudinally through the outer housing; and at least one turbulence-inducing structure in the flow passage, the turbulence-inducing structure being configured to disperse gas in a flow of produced fluid through the flow passage, in which the turbulence-inducing structure comprises first and second screens, and in which the first screen is circumferentially rotated relative to the second screen.

16. The gas dispersal tool of claim 15, in which each of the first and second screens extends across the flow passage.

17. The gas dispersal tool of claim 15, further comprising a steel wool positioned in the flow passage longitudinally between the first and second screens.

18. The gas dispersal tool of claim 15, in which the turbulence-inducing structure forms in the flow passage at least one of the group consisting of a circuitous channel, a restriction and a constriction.

19. The gas dispersal tool of claim 15, in which the turbulence-inducing structure is configured for removal from the well without removing a production string within which the turbulence-inducing structure is installed.

* * * * *